US008193461B2

(12) United States Patent
Spiessl

(10) Patent No.: US 8,193,461 B2
(45) Date of Patent: Jun. 5, 2012

(54) ELECTRICAL SWITCH, PARTICULARLY OF MICROSWITCH DESIGN

(75) Inventor: Georg Spiessl, Altendorf (DE)

(73) Assignee: emz-Hanuer GmbH & Co. KGaA, Nabburg (DE)

( * ) Notice: Subject to any disclaimer, the term of this patent is extended or adjusted under 35 U.S.C. 154(b) by 371 days.

(21) Appl. No.: 12/536,749

(22) Filed: Aug. 6, 2009

(65) Prior Publication Data

US 2010/0032270 A1 Feb. 11, 2010

(30) Foreign Application Priority Data

Aug. 11, 2008 (DE) ..... 10 2008 037 312

(51) Int. Cl.
*H01H 1/00* (2006.01)

(52) U.S. Cl. ..... 200/290

(58) Field of Classification Search ..... 200/290, 200/16 C, 16 F, 296, 409
See application file for complete search history.

(56) References Cited

U.S. PATENT DOCUMENTS 4,698,465 A * 10/1987 Oba ..... 200/16 F

FOREIGN PATENT DOCUMENTS

DE 26 57 783 A1 7/1977
DE 79 06 821 U1 6/1979

* cited by examiner

*Primary Examiner* — Vanessa Girardi
(74) *Attorney, Agent, or Firm* — Robert R. Deleault, Esq; Mesmer & Deleault, PLLC

(57) ABSTRACT

The invention relates to an electrical switch (10), particularly of microswitch design, comprising at least one pair of switching contacts (42, 60), which can be moved, relative to one another, between an in-contact position and an out-of-contact position, for the purpose of making and breaking an electrical path leading via the two switching contacts (42, 60), and comprising spring means (40), which bias at least one of the two switching contacts in the direction of one of the two relative positions, the spring means (40) comprising, according to a preferred design, a helical spring (40), which is made of an electrically conductive material, is loaded substantially in the direction of its spring axis, and is located in the electrical path in series with the switching contact pair (42, 60).

26 Claims, 5 Drawing Sheets

ELECTRICAL SWITCH, PARTICULARLY OF MICROSWITCH DESIGN

BACKGROUND OF THE INVENTION

The present invention relates to an electrical switch, particularly of microswitch design.

Electrical switches are mass-produced products used in numerous appliances that have electrical functions. A preferred, although not limiting, field of application of the switches considered here is that of door closures for washing machines, dishwashing machines, stoves and similar electrical domestic appliances (so-termed "white goods"). Microswitches, which, for example, operate in response to the closing of the door or in response to the locking of a closing element of the door closure, and thus allow various states of the closure to be identified, are often built into such door closures.

The mass-produced character of the switches considered here normally exerts a high cost pressure in production, with not only the manufacture of the individual parts, but also their fitting, being cost factors to be taken into account.

SUMMARY OF THE INVENTION

An object of the present invention is to provide an electrical switch that can be produced with a small resource input and has a high functional reliability.

This object is achieved, according to the invention, by an electrical switch, comprising at least one pair of switching contacts, which can be moved, relative to one another, between an in-contact position and an out-of-contact position, for the purpose of making and breaking an electrical path leading via the two switching contacts, and comprising spring means, which bias the two switching contacts relative to one another in the direction of one of their two relative positions. The spring means in this case comprise a coiled spring, which is made of an electrically conductive material, is located in the electrical path in series with the switching contact pair, and has at least one turn.

Within the scope of the invention, the term coiled spring comprises both axially acting helical springs and torsionally loaded torsion springs having spring legs that project approximately in a radial plane relative to the turn axis of the torsion spring. Such torsion springs are frequently also termed leg springs. Coiled springs are normally extremely reliable and have a long functional life. In addition, they are already commercially available as a mass-produced product, which does not require any special preparation, and is therefore cost-effective.

According to one embodiment, the coiled spring can be a helical spring loaded, particularly loaded in compression, substantially in the direction of its spring axis. It can be realized to be cylindrical, it being equally possible, however, to use a non-cylindrical coiled spring, for instance a barrel-shaped coiled spring.

A first of the two switching contacts can be located at an axial front face of the helical spring. In particular, it can be constituted directly by an end turn of the helical spring, such that no additional measures need be taken to constitute this switching contact (e.g. a welded-on contact plate). The second switching contact, on the other hand, is attached, expediently, in a fixed manner; this, likewise, is clearly not a necessity.

According to another embodiment, the coiled spring can be a torsion spring loaded in torsion, and one of the spring legs of the torsion spring can constitute a first of the two switching contacts.

In the case of a preferred development, the switch has two fixed conductor elements, which are made of electrically conductive material and arranged with a mutual spacing, the coiled spring being in constant contact with one of the conductor elements and being able to be brought into and out of contact with the other of the conductor elements by means of an actuating element. In particular, in the case of the coiled spring being realized as a helical spring, the actuating element can in this case be arranged to be movable in the direction of the axis of the helical spring, and, in the case of being realized as a torsion spring, be arranged to be movable in the transverse direction, in particular perpendicularly relative to the coil axis of the torsion spring. This is advantageous, in order to make the best possible use of the spring force of the coiled spring for the purpose of biasing the actuating element.

The switch according to the invention preferably has a switch housing, comprising a receiving shaft, into which the actuating element is inserted such that it can move up and down.

For simple, manual assembly, the actuating element is realized, advantageously, with formations that allow the coiled spring and the actuating element to be joined together to constitute a preassembly unit, before the actuating element is fitted to a housing of the switch. These formations can comprise, for example, a spring insertion space, which is constituted in the actuating element and into which the coiled spring can be inserted under bias. The fitting of the actuating element, equipped with the coiled spring, into the switch housing is then facilitated in that an alternative space, for a respective conductor element, adjoins the spring insert space on both sides, respectively.

At least one of the conductor elements, in particular both conductor elements, can be pushed through a through-opening in the actuating element. This can be used to achieve loss-proof fastening of the actuating element on a basic housing of the switch via the conductor element alone, without the need to take additional measures to secure the actuating element.

For good-quality contact with the coiled spring, and for simple and cost-effective production, the conductor elements are preferably realized in the form of pins. Alternatively, they can be realized, for example, in the form of strips or plates.

Further, it is to be pointed out that, although the conductor elements can be of like design, this is by no means imperative. Clearly, the two conductor elements can be of designs that differ from one another.

For a structurally simple design and a simple, rapid assembly of the switch according to the invention, the conductor elements can extend transversely through the receiving shaft and be held in the walls of the receiving shaft. For this purpose, the conductor elements can be pushed, from outside the receiving shaft, through push-through slots in a first wall region of the shaft, and be advanced transversely through the receiving shaft until they go into retaining recesses in a second wall region of the receiving shaft that is opposite the first wall region.

The push-through slots can open, on the side of the first wall region that is opposite the receiving shaft, into a space that serves to receive a connector plug. The switch according to the invention thus requires nothing, as electrically conductive components, other than the two conductor elements and the coiled spring, and fulfils the requirement for a small number of structural parts. Apart from these components, the switch according to the invention requires, in addition, only the switch housing and the actuating element, such that the switch overall can be assembled from no more than five components.

The receiving shaft can have, for example, a rectangular cross-section.

A particularly cost-effective design makes provision whereby the conductor elements are made of a wire material, in particular a wire material having a rectangular cross-section.

They can then be produced simply by being cut into lengths from a roll of wire, and need not be punched out of a sheet-metal material.

According to an embodiment of the present invention, the electrical switch can operate as a normally-closed contact, i.e., as an opener. Then, in the non-operative state of the switch, the switching contacts are in their in-contact position.

Alternatively, the electrical switch can operate as a normally-open contact, i.e., as a closer. In this case, the switching contacts assume their out-of-contact position in the non-operative state of the switch. In this case, there can be provided a spring element, which is separate from the coiled spring and acts counter to the latter, and which biases the two switching contacts in the direction of their out-of-contact position.

According to another aspect, the invention further achieves the object stated at the outset by an electrical switch, particularly of microswitch design, comprising

- a switch housing, comprising a receiving shaft,
- an actuating element, which is accommodated in the receiving shaft such that it can move up and down, and which is accessible from outside the switch,
- two conductor elements, of an electrically conductive material, which are arranged above one another in the receiving shaft in the direction of movement of the actuating element, and extend transversely through at least a part of the receiving shaft, and
- a spring element, of an electrically conductive material, which is arranged in the space between the two conductor elements or extends at least into this space, and which, in a first switching state of the switch, closes an electrical path via the two conductor elements and, in a second switching state, is brought by the actuating element out of contact with at least one of the conductor elements.

In the case of this aspect, the spring element can be, for example, a coiled spring in the form of a helical spring or a torsion spring. Likewise conceivable is the use of a leaf spring, for instance in a V shape, one of the limbs of the V being constantly in contact with one of the conductor elements, and the other limb of the V being brought, by the actuating element, into contact and out of contact with the other conductor element.

BRIEF DESCRIPTION OF THE DRAWINGS

The invention is explained further in the following with reference to the appended drawings, wherein.

DETAILED DESCRIPTION OF THE PREFERRED EMBODIMENT

Figure 7:
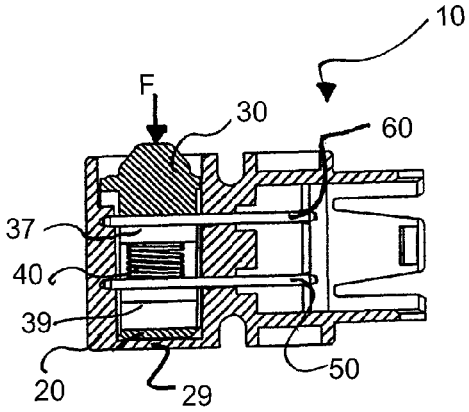
FIG. 7 shows a sectional view similar to FIG. 1, but with the switch of FIG. 1 being in the open, actuated state.
Figure 8:
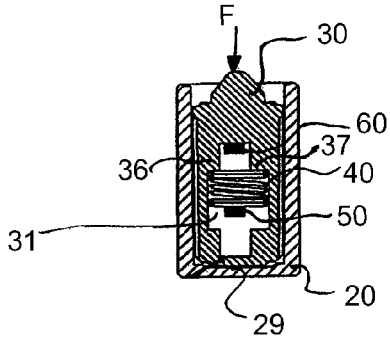
FIG. 8 shows a section similar to FIG. 3, with the switch of FIG. 1 being in the actuated state.

In the case of the on/off microswitch represented in FIG. 1 to 8, which is denoted in general by the reference 10, FIGS. 1 to 6 relate to the non-actuated switching state of the switch, in which a switching-contact pair of the switch that is responsible for the on/off function is in mutual electrical contact (in-contact position) and thus closes an electrical path that runs via the contact pair, while FIGS. 7 and 8 show the actuated switching state, in which the two switching contacts are separate from one another (out-of-contact position) and, accordingly, the electrical path is broken. The switch 10 thus operates as a normally-closed contact.

In total, the switch 10 according to the exemplary embodiment shown in FIGS. 1 to 8 is composed of five components. These are: a switch housing 20, an actuating element 30, an electrically conductive spring element in the form of a cylindrical helical spring 40, and two metallic conductor pins 50, 60. The switch housing 20, which is preferably made of plastic, for example as an injection-moulded part, is realized as a single piece and has a receiving shaft 23 for the actuating element 30, which receiving shaft is open outwardly and closed at its base. The actuating element is inserted in the shaft 23 from the outside and, when in the fitted state, can be moved up and down in the shaft 23 in the direction of a double arrow A (see FIG. 2).

In the following, the arrow direction A is also referred to as the axial direction, because it coincides with the direction in which the helical spring 40 is fitted.

In the exemplary case shown, the receiving shaft 23 has a rectangular cross-section and is delimited, correspondingly, by four shaft side-walls arranged in a rectangle. Of these four shaft side-walls, two are emphasized separately in the figures, and denoted by references 21 and 22. The two walls 21, 22 are opposite one another, and serve to retain and support the two conductor pins 50, 60 on the switch housing 20. For this purpose, the switch side-wall 21 is provided with two retaining recesses 25, 26 for the tips of the conductor pins 50, 60, which retaining recesses are arranged above one another at a distance in the arrow direction A (i.e. in the axial direction). The retaining recesses 25, 26 are shaped into the wall 21 from the inside of the shaft, and preferably extend only through a part of the thickness of the wall 21. They can thus delimit the insertion depth of the conductor pins 50, 60. In the shaft side-wall 22, on the other hand, there are two push-through slots 27, 28 for the conductor pins 50, 60, which push-through slots extend fully through the wall 22. The push-through slots 27, 28 are arranged such that they are precisely axially opposite the retaining recesses 25, 26, and allow the conductor pins 50, 60 to be pushed through from the outside of the shaft side-wall 22.

When in the fitted state, the two conductor pins 50, 60 extend transversely through the shaft 23 and reach, with their tips, into the retaining recesses 25, 26. They thereby lie parallelwise in relation to one other and axially above one another, and extend perpendicularly in relation to the axial direction A.

The length of the conductor pins 50, 60 is so selected that, when in the fitted state, they protrude slightly outwards into a housing space 24 that serves to receive a connector plug, not represented in greater detail, to which the switch 10 can be coupled. The part of the housing 20 that surrounds the space 24 constitutes, correspondingly, a plug socket for the connector plug.

For the purpose of fitting, the conductor pins 50, 60 are introduced into the housing space 24 from the open side of the plug socket, and are pushed through the push-through slots 27, 28. They are then advanced until, with their leading ends, they go into the retaining recesses 25, 26 and cannot be advanced further. It is understood that the retaining recesses 25, 26 and/or the push-through slots 27, 28 can be of sufficiently constricted size or otherwise designed to ensure that the conductor pins 50, 60 are retained in the housing 20 in a loss-proof manner.

The actuating element 30 has, corresponding to the receiving shaft 23, a rectangular contour as viewed in an axial cross-section. It has an axially elongate, slot-type opening 32, which extends transversely through the actuating element 30 from one rectangular side to the opposite rectangular side, and which is delimited downwardly and upwardly in the axial direction by the material of the actuating element 30. In a middle region, the slot 32 is widened, transversely relative to the slot plane, to constitute a spring insertion space 31 (see FIG. 8), into which the helical spring 40 can be inserted with the spring axis parallel to the arrow direction A. The axial height of the spring insertion space 31 is somewhat less than the axial length of the helical spring 40 in the non-tensioned state, such that the helical spring 40 must be compressed somewhat to enable it to be inserted in the spring insertion space 31. This is favourable for assembling of the switch 10, because the helical spring 40 can be assembled with the actuating element 30 to constitute a preassembly unit and, because of its inherent biasing, it does not fall out of the spring insertion space 31.

The slot regions axially above and below the spring insertion space 31 constitute alternative spaces 34, 35 (see FIG. 3) for the conductor pins 50, 60, into which the pins 50, 60 can recede axially upon a movement of the actuating element 30 in the shaft 23. Since the alternative spaces 34, 35 are narrower, transversely relative to the slot plane, than the spring insertion space 31, the helical spring 40 remains confined to the spring insertion space 31, whereas the conductor pins 50, 60 can move between the spring insertion space 31 and the alternative spaces 34, 35.

Figure 3:
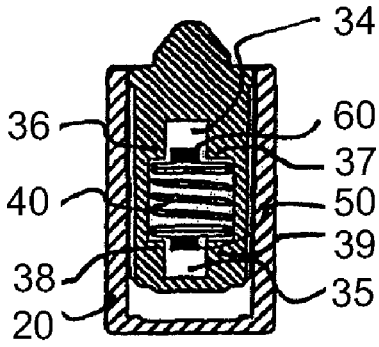
FIG. 3 shows another section through the switch of FIG. 1.
Figure 4:
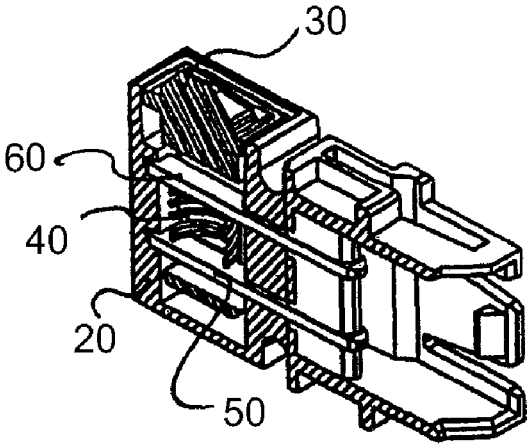
FIG. 4 shows a perspective view of the switch of FIG. 1, in the uncovered state.
Figure 5:
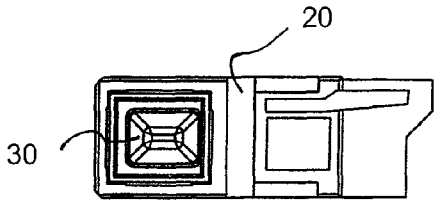
FIG. 5 shows a view of the switch of FIG. 1 from above.
Figure 6:
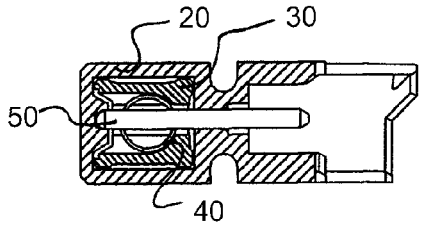
FIG. 6 shows yet another section through the switch of FIG. 1.

The transition steps between the spring insertion space 31 and the alternative spaces 34, 35 that adjoin axially on both sides are denoted by the references 36, 37, 38, 39 (see, in particular, FIGS. 3 and 8). Via these steps, the helical spring 40 bears axially on the actuating element 30.

The actuating element 30 has an actuating head 41, which projects at least slightly from the shaft 23 and which, via an external manipulation element (not represented in greater detail), can act upon the actuating element 30 for the purpose of switch actuation. Expediently, the actuating element 30 is also made of plastic.

Figure 1:
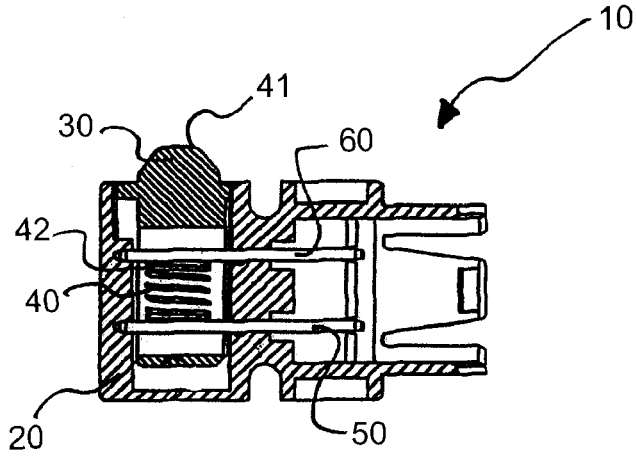
FIG. 1 shows, in section, an exemplary embodiment of an on/off switch that operates as a normally-closed contact, which switch is shown in the closed, non-actuated state.
Figure 2:
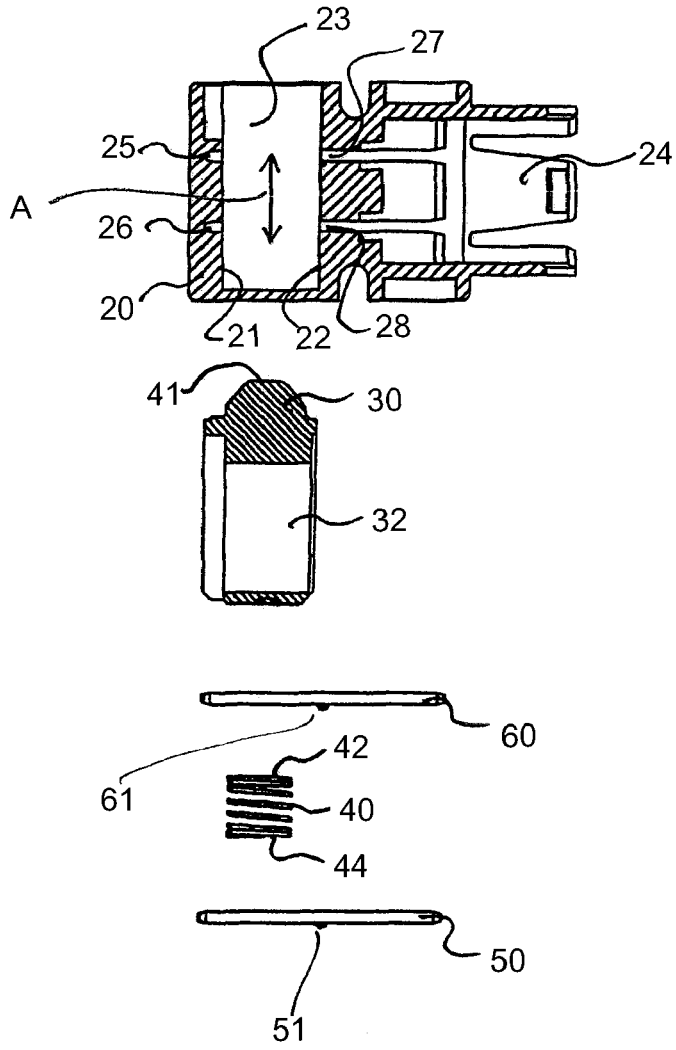
FIG. 2 shows the individual components of the switch of FIG. 1.

In the fitted state, as shown, for example, in FIGS. 1 and 3, the two conductor pins 50, 60 extend through the slot 32. This means that both conductor pins 50, 60 are inserted through the actuating element 30, which thus cause the latter to be held on the housing 20 in a loss-proof manner. The helical spring 40 is located axially between the two conductor pins 50, 60. It upper end turn (denoted by the reference 42, see FIG. 2) in this case bears on the upper conductor pin 60, producing an electrical contact, while its lower end turn (denoted by the reference 44) bears on the lower conductor pin 50, likewise producing an electrical contact. A closed electrical path, from the conductor pin 60 to the conductor pin 50, via the helical spring 40, is thus constituted.

For a full electrical contact between the helical spring 40 and the conductor pins 50, 60, it is expedient if, in the final assembled state, the axial support of the helical spring 40 is effected substantially exclusively via the conductor pins 50, 60 and, accordingly, the bearing contact of the helical spring 40 with the transition steps 36-39 is removed, at least insofar as possible. For this purpose, the axial distance between the two conductor pins 50, 60 (determined by the axial distance between the retaining recesses 25, 26 and between the push-through openings 27, 28) is somewhat less than the axial distance between respectively axially opposing steps of the transition steps 36-39. At the same time, the retaining recesses 25, 26 and the push-through openings 27, 28 are so located that, in the fitted state, both conductor pins 50, 60 project somewhat into the spring insertion space 31. Consequently, when the switch is in the non-actuated state, the helical spring 40 is held in compression between the two conductor pins 50, 60.

In the case of the switch 10, the upper conductor pin 60 and the end turn 42 of the helical spring 40 constitute a pair of switching contacts, which are movable towards one another, within the meaning of the invention. In this case, the switching contact constituted by the conductor pin 60 is fixed, while the switching contact constituted by the end turn 42 is movable.

The ends of the conductor pins 50, 60 that project from the shaft side-wall 22 into the housing space 24 serve as electrical interface elements for contacting with complementary interface elements of the connector plug.

For the purpose of operating the switch 10, the actuating element 30 is pressed down, i.e. in the direction into the shaft 23, as indicated by an arrow F in FIGS. 7 and 8. The shaft base, denoted by the reference 29, delimits the maximum downward travel of the actuating element 30. Upon the downward movement of the actuating element 30, the steps 36, 37 press upon the helical spring 40. The latter becomes compressed, and lifts away from the upper conductor pin 60. As a result, the electrical connection between the two conductor pins 50, 60 is broken; the switch 10 is open.

If the actuating force is removed, the actuating element 30 moves back upwards, under the action of the relaxing helical spring 40, until the helical spring 40 comes back into bearing contact on the upper conductor pin 60. The switch 10 is then back in the closed state.

For assembling of the switch 10, the helical spring 40 is first inserted in the spring insertion space 21 of the actuating element 30. The actuating element 30, with the helical spring 40 held therein, is then introduced into the receiving shaft 23 of the switch housing 20, being so inserted to the extent that the lower conductor pin 50 can be inserted without difficulty in the housing 20 and can thereby be threaded through the lower alternative space 35. The actuating element 30 is then pressed more deeply into the shaft 23. This compresses the helical spring 40, which now comes into contact with the already fitted lower conductor pin 50. The actuating element 30 is now pressed so deeply into the shaft 23 that the upper conductor pin 60 can be inserted in the housing 20 and thereby threaded through the upper alternative space 34. The actuating element 30 can then be released; the assembling operation is complete.

The conductor pins 50, 60 are composed, for example, of a wire material having a rectangular, in particular a square, cross-section but, alternatively, they can be produced from a round wire. It can be seen in FIG. 2 that they have a small protruding bead 51 and 61, respectively, which, upon the pins 50, 60 being fitted with the respective push-through opening 27, 28, comes into bearing contact and sinks into the material of the plug housing 20. This causes the pins 50, 60 to be retained securely in the housing 20.

It is pointed out that, instead of a helical form of the spring 40, another form of an electrically conductive, yet elastic element can be selected, without the simplicity of assembling being significantly impaired and the low number of switch components being increased as a result. The idea of a switch having an actuating element that can be fitted in a loss-proof manner by means of two conductor elements that can be inserted through it and are held on a housing of the switch, whereas an electrically conductive spring element that, for its part, can to be preassembled with the actuating element to constitute a unit, being located between the two conductor elements, is regarded as being independently patentable within the scope of the invention, this being irrespective of whether the spring element is coiled or is of another design.

Figure 9:
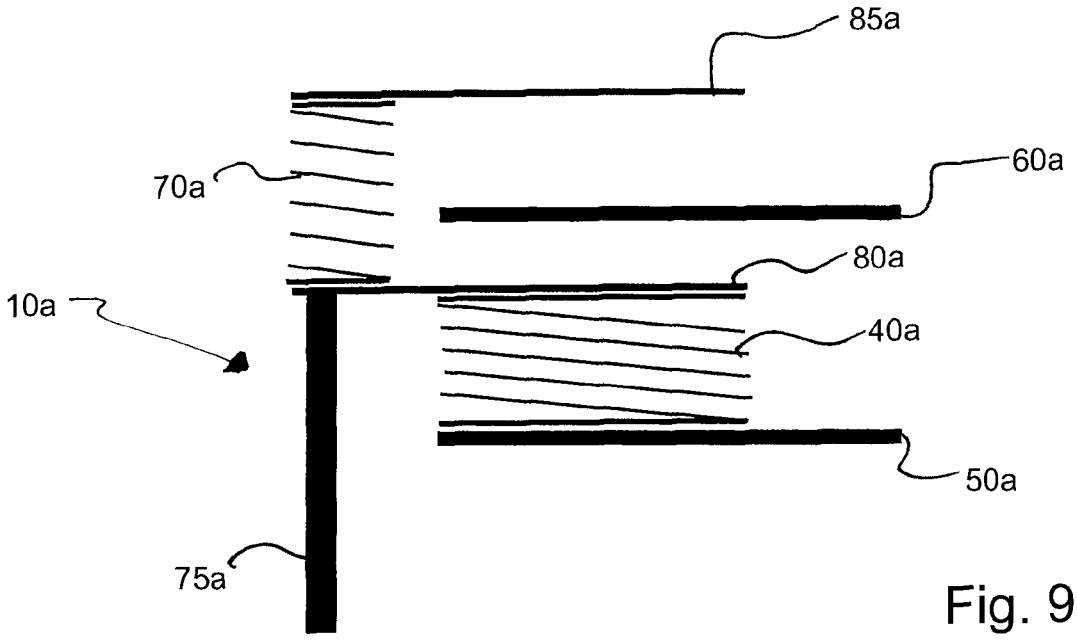
FIG. 9 shows, in highly schematic form, the functioning principle of an on/off switch that operates as a normally-open contact, which switch is shown in the non-actuated state.
Figure 10:
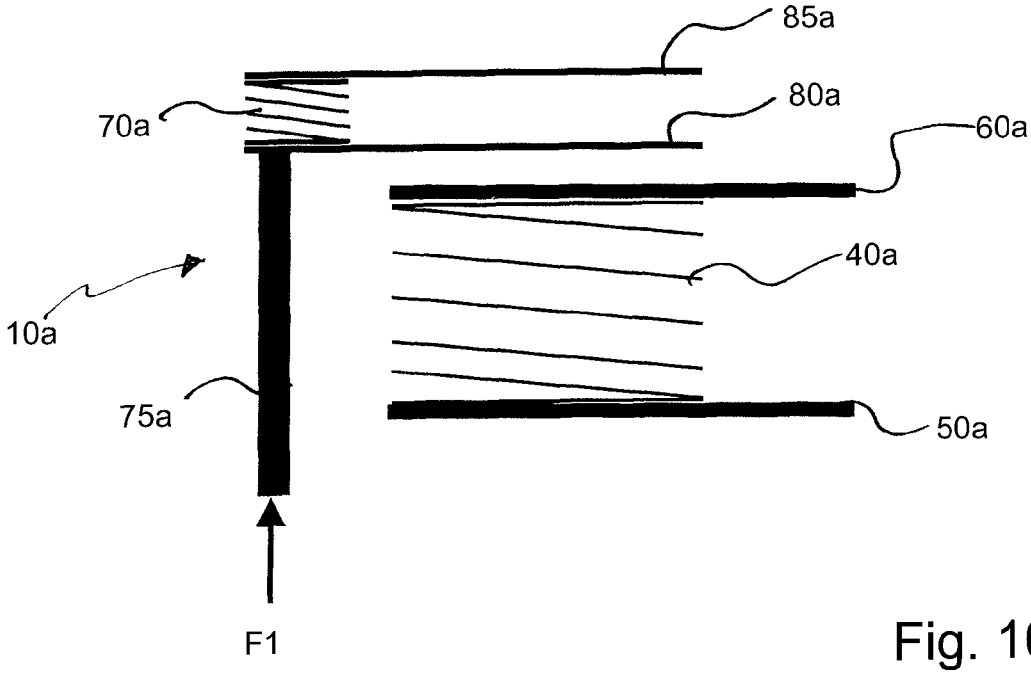
FIG. 10 shows the switch of FIG. 9 in the actuated state.
Figure 11:
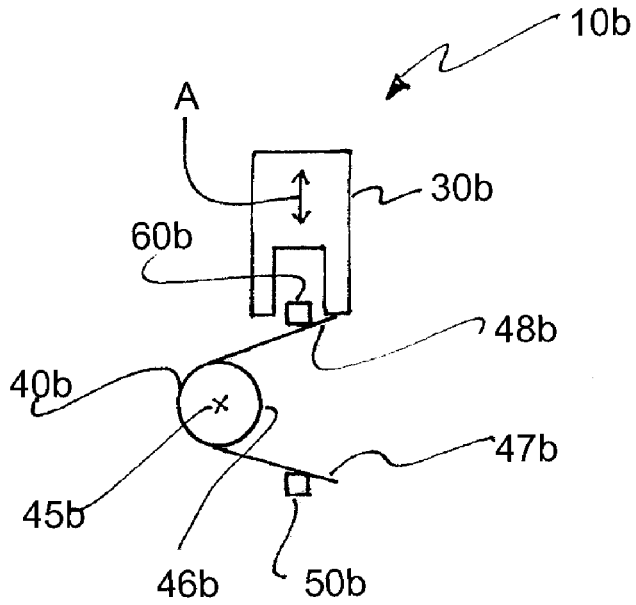
FIG. 11 shows a schematic diagram of a switch variant comprising a torsion spring.

For the following explanation of the exemplary embodiments of FIGS. 9, 10 and 11, use is made of the same references as previously, insofar as reference is made to the same or like-acting components. In order to distinguish the exemplary embodiments, a lower-case letter is, of course, appended to the references in each case.

The switch 10*a* according to the exemplary embodiment of FIGS. 9, 10 is an on/off switch that operates as a normally-open contact. It has a first conductor element 50*a*, a second conductor element 60*a*, an electrically conductive first spring element 40*a* arranged between the conductor elements 50*a*, 60*a*, an actuating element 75*a* having, attached thereto, an actuating portion 80*a* for actuating the switch, and a second spring element 70*a*, which is arranged between a housing part 85*a* and the actuating portion 80*a*. The conductor elements 50*a*, 60*a* can again be in the form of, for example, pins. The first spring element 40*a* can be, as previously, a helical spring 40*a* loaded in compression. The second spring element 70*a* is not part of the electrical path running via the conductor elements 50*a*, 60*a* and the spring element 40*a*; it can therefore be composed, if appropriate, of an electrically non-conductive material.

The conductor elements 50*a*, 60*a* and the actuating portion 80*a* are arranged in differing vertical planes, such that the actuating portion 80*a* can be moved out of the position below the conductor element 60*a*, as shown in FIG. 9, into the position above the conductor element 60*a*, as shown in FIG. 10.

If there is no force $F_1$ acting upon the actuating element 75*a*, the electrical switch is in the equilibrium position shown in FIG. 9, in which the electrical connection between the first 50*a* and the second conductor element 60*a* is broken by means of the first spring element 40*a*. In this case, the spring forces of the first spring element 40*a* and of the second spring element 70*a* act in opposing directions in such a way that the electrical switch remains in the out-of-contact position shown in FIG. 9.

If, as shown in FIG. 10, a force $F_1$ then acts upon the actuating element 75*a*, the actuating portion 80*a* is moved into a position in a plane horizontally above the conductor element 60*a*. In this case, the second spring element 70*a*, which is arranged between the housing part 85*a* and the actuating portion 80*a*, becomes compressed. Since the first spring element 40*a* is no longer being held by the actuating portion 80*a*, it can extend out of the more compressed state shown in FIG. 9, into the less compressed state shown in FIG. 10, until it comes into contact with the conductor element 60*a*. Thus, in FIG. 10, an electrical connection is produced between the conductor elements 50*a*, 60*a*, via the first spring element 40*a*. Upon removal of the force $F_1$ upon the actuating element 75*a*, the spring element 40*a* returns to the out-of-contact position shown in FIG. 9; the switch re-opens.

The switch variants of FIGS. 11 and 12 again each constitute a normally-closed contact for switching an electrical path on and off. They differ from the exemplary embodiment of FIGS. 1 to 8, in essence, in the form of the spring seated between the conductor pins. In the case of FIG. 11, the spring 40*b* is realized as a torsion spring (leg spring), which, with its spring axis, denoted by the reference 45*b*, lies perpendicularly relative to the direction of movement of the actuating element 30*b*. The torsion spring 40*b* has, in known manner, an axially central spring portion 46*b* constituted by one or more turns of a spring wire, and, at each of its axial ends, has a spring leg 47*b* and 48*b*, respectively, projecting approximately in a radial plane. In this case, the lower spring leg 47*b* in FIG. 11 bears constantly, under bias, on the lower conductor pin 50*b*, while, in the non-operative state of the switch 10*a* (closed-circuit state), the upper spring leg 48*b* bears on the upper conductor pin 60*b*, but is pressed away out of contact with the conductor pin 60*b* upon the switch being actuated by the actuating element 30*b*, such that the switch opens.

Figure 12:
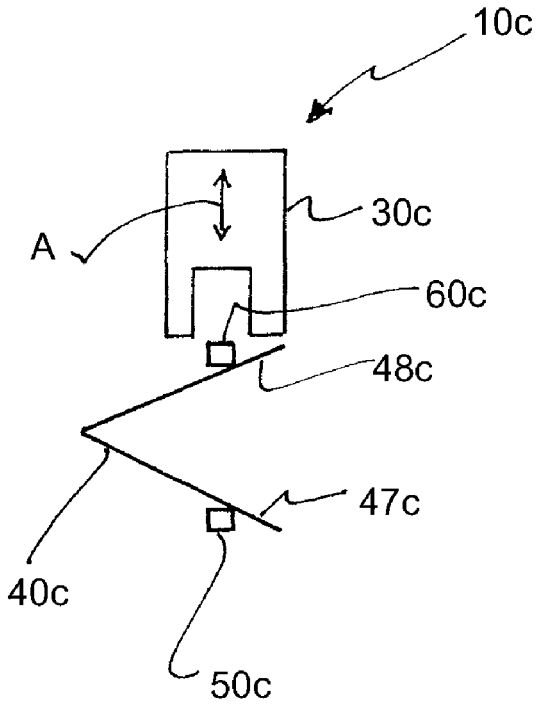
FIG. 12 shows a schematic diagram of a switch variant comprising a leaf spring.

In the case of the variant of FIG. 12, on the other hand, the spring element 40*c* is realized as a leaf spring, bent in a V shape, the V limbs 47*c*, 48*c* of which act together with the conductor pins 50*c*, 60*c*. It is understood that, as an alternative to a V shape, a leaf spring bent in a round or other form can be used, for example bent in a C shape.

What is claimed is:

1. An electrical switch comprising:

at least one pair of switching contacts movable with respect to each other between an in-contact position for establishing an electrical path leading via the two switching contacts and an out-of-contact position for breaking said electrical path;

at least one spring member for biasing the two switching contacts relative to one another towards one of the in-contact position and out-of-contact position, the at least one spring member including a coiled spring made of an electrically conductive material and disposed in the electrical path in series with the pair of switching contacts;

first and second spaced-apart conductor elements made of electrically conductive material, wherein the coiled spring is in constant contact with the first conductor element; and an actuating member for bringing in and out of mutual contact the coiled spring and the second conductor element wherein the first and second conductor elements are arranged above one another in a direction of movement of the actuating member and extend through respective push-through slots into a plug receiving space designed to receive a connector plug and wherein the coiled spring is arranged in, or extends into, a space between the first and second conductor elements.

2. The electrical switch of claim 1, wherein the switch is a microswitch design.

3. The electrical switch of claim 1, wherein the first and second conductor elements are fixedly disposed in a housing of the switch.

4. The electrical switch of claim 1, wherein the actuating member is designed to allow the coiled spring and the actuating member to be joined together to constitute a preassembly unit, before the actuating member is fitted to a housing of the switch.

5. The electrical switch of claim 1, wherein the actuating member has a spring insertion space for accommodating the coiled spring under bias.

6. The electrical switch of claim 1, wherein at least one of the first and second conductor elements extends through a through-opening in the actuating member.

7. The electrical switch of claim 1, wherein the electrical switch operates as a normally-closed contact.

8. The electrical switch of claim 1, wherein the coiled spring is a torsion spring, the torsion spring having a protruding leg forming one of the pair of switching contacts.

9. The electrical switch of claim 8, wherein the actuating member is arranged to be movable in a direction transverse to a coil axis of the torsion spring.

10. The electrical switch of claim 1, wherein the electrical switch operates as a normally-open contact.

11. The electrical switch of claim 10, further comprising a spring element which is separate from the helical spring and acts counter to the helical spring, and which biases the pair of switching contacts towards the out-of-contact position.

12. The electrical switch of claim 1, wherein the first and second conductor elements are realized in the form of pins.

13. The electrical switch of claim 12, wherein the first and second conductor elements are made of a wire material.

14. The electrical switch of claim 13, wherein the wire material has a rectangular cross-section.

15. The electrical switch of claim 1, wherein the coiled spring is a helical spring loaded in a direction of a spring axis thereof.

16. The electrical switch of claim 15, wherein the actuating member is arranged to be movable in the direction of the spring axis of the helical spring.

17. The electrical switch of claim 15, wherein the helical spring is a compression helical spring.

18. The electrical switch of claim 15, wherein the helical spring is cylindrical.

19. The electrical switch of claim 15, wherein one of the pair of switching contacts is located on an axial front face of the helical spring.

20. The electrical switch of claim 19, wherein the one of the pair of switching contacts is formed by an end turn of the helical spring.

21. The electrical switch of claim 1, further comprising a housing having a receiving opening for receiving the actuating member for up and down movement therein.

22. The electrical switch of claim 21, wherein the receiving opening has a substantially rectangular cross-section.

23. The electrical switch of claim 21, wherein the first and second conductor elements extend transversely through the receiving opening of the housing and are held in walls surrounding the receiving opening.

24. The electrical switch of claim 23, wherein the first and second conductor elements can be pushed, from outside the receiving opening, through push-through slots in a first wall portion of the receiving opening, and be advanced transversely through the receiving opening until they go into retaining recesses in a second wall portion of the receiving opening that is opposite the first wall portion.

25. The electrical switch of claim 24, wherein the push-through slots open, on the side of the first wall portion that is opposite the receiving opening, into the plug receiving space.

26. An electrical switch comprising:

a housing having a receiving shaft;

an actuating member accommodated in the receiving shaft for up and down movement, the actuating member being accessible from outside the switch;

a pair of conductor elements made of an electrically conductive material and arranged above one another in the receiving shaft in a direction of movement of the actuating member, the pair of conductor elements extending transversely through at least a part of the receiving shaft; and a spring made of an electrically conductive material and arranged in, or extending into, a space between the pair of conductor elements, wherein the spring, in a first switching state thereof, closes an electrical path via the pair of conductor elements wherein the spring is in a relaxed state and electrically disposed between the pair of conductor elements and, in a second switching state, is brought by the actuating member out of contact with at least one of the pair of conductor elements wherein the spring is in a compressed state.

* * * * *